US005115608A

United States Patent [19]

Abraham et al.

[11] Patent Number: 5,115,608

[45] Date of Patent: May 26, 1992

[54] PANEL SUPPORT STRUCTURE

[75] Inventors: Leslie R. Abraham; Ronald N. Probst, both of Owatonna, Minn.

[73] Assignee: Wenger Corporation, Owatonna, Minn.

[21] Appl. No.: 496,082

[22] Filed: Mar. 15, 1990

Related U.S. Application Data

[63] Continuation of Ser. No. 33,554, Apr. 1, 1987, abandoned.

[51] Int. Cl.[5] ..... E04B 2/78

[52] U.S. Cl. ..... 52/238.1; 52/126.6; 472/77

[58] Field of Search ..... 52/126.1, 238.1, 243.1, 52/126.6; 272/21, 22; 280/79.11, 79.2, 79.3, 79.7; 160/350, 351

[56] References Cited

U.S. PATENT DOCUMENTS

| | | | |
|---|---|---|---|
| 2,143,235 | 1/1939 | Bassett | 272/21 |
| 2,204,880 | 6/1940 | Bell | 272/21 |
| 3,002,557 | 10/1961 | Roth et al. | 52/351 |
| 3,433,500 | 3/1969 | Christensen | 280/79.2 |
| 3,527,470 | 9/1970 | Ord | 280/79.2 |
| 3,547,459 | 12/1970 | Lapham | 280/79.2 |
| 4,625,476 | 12/1986 | Shimada | 52/238.1 |
| 4,662,131 | 5/1987 | Glochenstein | 52/238.1 |

FOREIGN PATENT DOCUMENTS

| | | | |
|---|---|---|---|
| 85905 | 8/1983 | European Pat. Off. | 272/21 |
| 145409 | 6/1985 | European Pat. Off. | 52/238.1 |

*Primary Examiner*—Richard E. Chilcot, Jr.
*Assistant Examiner*—Joanne C. Downs
*Attorney, Agent, or Firm*—Dorsey & Whitney

[57] ABSTRACT

A support structure for mounting and rollably supporting stage backdrop panels and the like is disclosed. A base frame includes a plurality of caster mounting members, with each mounting member rotatable relative to the base frame about an individual mounting member axis. A plurality of casters are rotatably carried by each mounting member, each caster being offset from the axis of its respective mounting member. Several of the mounting members can be attached to the base frame by telescoping fittings, allowing the height of the base frame to be adjusted without disengaging the casters from rollable engagement with the stage floor.

16 Claims, 4 Drawing Sheets

PANEL SUPPORT STRUCTURE

This application is a continuation of Ser. No. 07/033,554, filed Apr. 1, 1987, now abandoned.

TECHNICAL FIELD

The present invention deals broadly with a technology dealing with support structures. More narrowly, however, the invention covered by this document deals with support structures for mounting panels, such as those employed in creating stage backdrops, so that they can be interfitted together to complete the full backdrop. A preferred embodiment of the invention is directed to structure for facilitating movement of panels relative to other panels and for rendering them more easily and accurately interfittable.

BACKGROUND OF THE INVENTION

Various examples can be given of instances in which panels are supported in a general vertical orientation for one reason or another. The most readily apparent of these examples, and the primary application for which the present invention is intended, is one wherein panels are placed into position relative to one another to form a backdrop.

Various types of backdrops can be formed. For dramatic productions, the backdrop would, typically, be a scenery backdrop depicting a site where action is to take place. Other types of backdrops exist, however. For example, for concerts, it might be desirable to provide one consisting of a plurality of similarly reliefed sections.

In either case, however, it is important that adjacent panels be correctly aligned and that they abut one another so that corresponding lateral edges engage. In some circumstances, it might be particularly important that a plane defined by the adjacent panels be substantially vertical.

These characteristics are desireable in the case of a scenery backdrop so that lines defining the scenery are not broken and out of alignment. In the case of a backdrop for a concert, alignment and common plane definition is important so that the backdrop appears to be a single, continuous panel.

In the prior art, the intended results here-in-before defined were achieved in ways which left much to be desired. A typical structure for setting up backdrop panels employed a base frame which was disposed for movement over the floor of the stage or other surface. A pair of wheels, an axis between which defined a front of the base frame at which the panel was to be mounted, afforded maneuverability. The wheels were not free to pivot about any vertically extending axis. Rather, they defined generally parallel, vertically extending planes, and they rotated only about the axis of the axle to which they were mounted.

The base frame afforded multiple point contact, a third, and, sometimes, a fourth point of contact being provided. These additional point or points of contact were spaced rearwardly from the front of the base frame and, in some structures, employed casters which were free to revolve 360 degrees about axes which, when the support was in position, extended generally vertically.

A significant drawback to such structures was their maneuverability. While rear ends of the base frames might be able to be moved laterally, it was, typically, more important that the front ends be readily able to be moved laterally so that edges of backdrop segments could be brought into engagement. The only way this was accomplished was by moving an assembly back and forth so that it could be "worked" laterally until it was at the appropriate location.

Another problem with prior art structures—and one which is probably more significant—is one occasioned by the manner in which vertical adjustment and alignment of the panels was effected. Each point of contact, had, associated therewith an outrigger-type structure. The outriggers were spaced laterally at some distance from the point of contact, regardless of whether that point of contact comprised a wheel disposed for rotation about a horizontal axis, or a caster which was free to rotate through 360 degrees about a generally vertically extending axis. A bottom pad of each outrigger was, normally, elevated from the surface over which the support was moved, but, once the support was in an appropriate location, the outrigger pads could be lowered to engage the floor and lift the wheels or casters to positions elevated above the floor. The outriggers, thereby, served not only as leveler adjustments, but also as brakes to hold a support and its mounted panel at a desired location.

While certain advantages were obtained by utilizing such a structure (for example, immobility of a panel once it was in position) serious drawbacks were experienced during the actual positioning process. The panels, after having been secured to their respective mounting towers extending upwardly from base frames of the various supports, were maneuvered so that their edges, it was intended, would abut when in proximity to one another.

Forward outriggers would be lowered and lower edges of the panels substantially aligned at the same height. Thereafter, rear outriggers would be lowered to bring their pads into engagement with the floor and tilt the panels so that adjacent panels which were intended to do so, defined a common plane. In the process of adjusting the tilt of the panels, however, it frequently became necessary to maneuver a support, and, in order to do this, the outriggers had to be retracted upwardly to, again, bring the wheels and casters into engagement with the floor. Fine-tuning adjustments were then made, the outriggers, therafter, again being lowered to make final alignment manipulations.

As will be able to be seen in view of this discussion, lowering and raising of the outriggers often had to have been performed repetitively. As a result, precious time was often wasted. Time economization is, however, particularly important during the staging of a play, and crew members are often severely limited in the amount of time available to make backdrop changes.

It is to these problems of the prior art and desirable features dictated thereby that the present invention is directed. It is a panel support which affords not only significant maneuverability, but also ease and economization of adjustability.

SUMMARY OF THE INVENTION

The present invention is a support structure for mounting panels which includes a base frame to which at least one panel can be mounted in a desired orientation. The base frame is supported by a plurality of caster mounting members, each member being disposed for rotation, through 360 degrees, about an axis. It is intended that the axes about which the caster mounting members rotate be substantially parallel. Each mounting member, in turn, carries a plurality of casters. The casters are disposed for revolution, through 360 degrees, about axes which are generally parallel to axes of other casters carried by a corresponding mounting member.

A preferred embodiment of the invention employs, additionally, means for affording the ability to level both the front and back of the base frame. The leveling means employed is one wherein leveling of the front of the base frame, to align bottom edges of the panels carried thereby, is accomplished without, concurrently, detracting from maneuver- ability. A telescoping element is, in this embodiment, provided at a location intermediate the base frame and a caster mounting member. As leveling is accomplished, therefore, the assembly of the panel and its support can still be maneuvered.

In accordance with the preferred embodiment, the telescoping elements can be made substantially coaxial with axes about which their respective caster mounting members rotate. Greater stability is, thereby, afforded.

The present invention is, thus, an improved structure for supporting panels such as those used in stage backdrops, for maneuvering those panels into position relative to one another to complete a backdrop, and for adjusting one panel relative to an adjacent panel so that they form a continuity. More specific features of the invention and advantages obtained in view of those features will become apparent with reference to the DETAILED DESCRIPTION OF THE INVENTION, appended claims, and accompanying drawing figures.

DETAILED DESCRIPTION OF THE INVENTION

Figure 1:
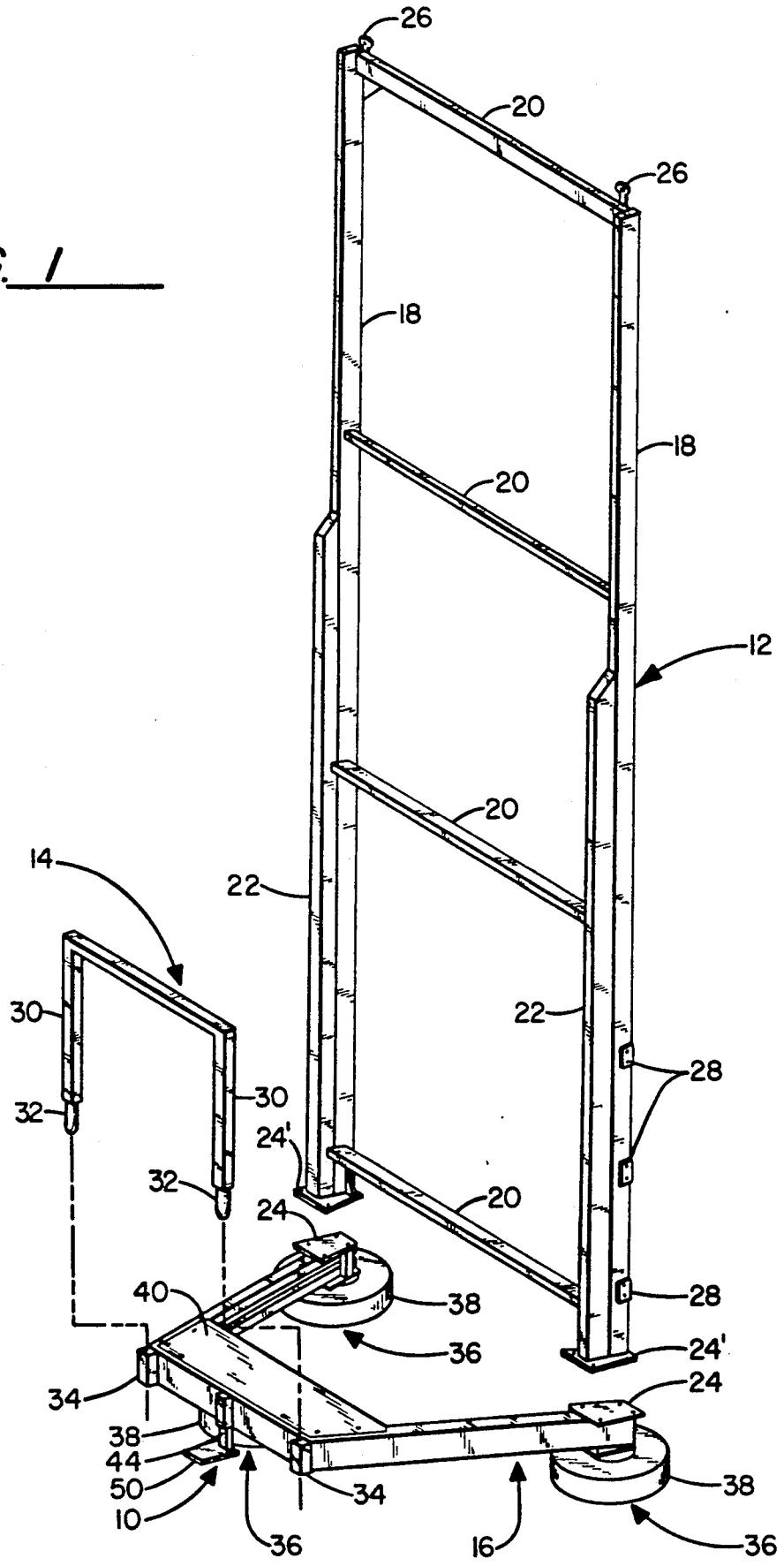
FIG. 1 is an exploded perspective view of a support in accordance with the present invention.

Referring now to the drawings wherein like reference numerals denote like elements throughout the several views, FIG. 1 illustrates a support structure 10 in accordance with the present invention, as shown with a tower frame 12, to which a face panel (not shown) can be mounted, and a maneuvering handle 14. The support structure 10 mounts on, at an end of a base frame 16 defined as the front, the tower frame 12. The tower frame 12 includes, as illustrated in FIG. 1, a pair of generally vertically extending members 18 which are interconnected, at various locations therealong by horizonal stays 20. The vertically extending members 18 are strengthened by backing pieces 22 and mounted to mating plates 24', one at the bottom of each member 18. The mating plates 24' are for the purpose of being brought into engagement, in mating relationship, with corresponding plates 24 on the base frame 16 of the support structure 10.

The tower frame 12 is provided with various fittings by means of which a face panel can be held on the tower frame 12. FIG. 1 illustrates a pair of eyelets 26 secured to the tower frame 12 at the uppermost interconnecting horizontal stay 20. Additionally, other fittings 28 can be provided to more effectively secure the face panel to the tower frame 12.

FIG. 1 illustrates a maneuvering handle 14 which is in the form and orientation of an inverted U. The distal end of each arm 30 of the U is provided with a plug portion 32, and corresponding female fittings 34 are provided proximate the rearward end of the base frame 16 of the support structure 10 to receive these plugs 32. When the handle 14 is mated to the support structure base frame 16, it is intended that it extends sufficiently high so that a stage hand or person moving the panels would find an interconnecting portion of the U-shaped member 14 accessible.

The embodiment of the support structure 10 illustrated in the figures is shown as having a base frame 16 and three caster assemblies 36, covered by corresponding assembly cowls 38, carrying the base frame 16, the assemblies 36 functioning to provide three point contact support. The specific construction of each caster assembly 36 will be discussed here-in-after.

Figure 9:
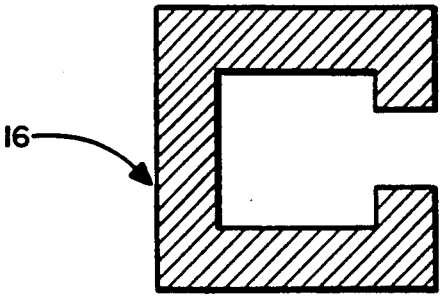
FIG. 9 is a sectional view taken through a strut of the base frame.

The base frame 16 of the support 10, in the embodiment illustrated, defines a generally trapezoidal-shaped frame. The perimeter of the frame is formed from stock generally C-shaped in cross-section. FIG. 9 illustrates, in section, the type of stock which, it is envisioned, would be employed. An open end of the C would face inwardly toward the interior of the defined trapezoidal-shaped structure. By so constructing the base frame 16, in part, it can be afforded strength sufficient to accomodate the backdrop panel and other elements carried thereby.

As previously discussed, an open end of the trapezoidal-shaped structure defines what forms the front of the support structure 10 in that a panel would extend along an axis defined by this open end of the structure and, when properly in position, obscure the bulk of the support structure 10 behind the panel. Because such panels tend to be large and, often, heavy, the center of gravity of a support structure 10 having a panel mounted thereto would be shifted toward the front of the overall assembly. Consequently, as the center of gravity approaches the front edge, the assembly could become quite unstable. As a result, a counter-weight box 40 having one or more counter-weights (not shown) carried therein can be provided near the rear of the assembly. The weight and number of the counter-weights can be varied depending upon the size and weight of the panel being carried by the support structure 10.

Figure 2:
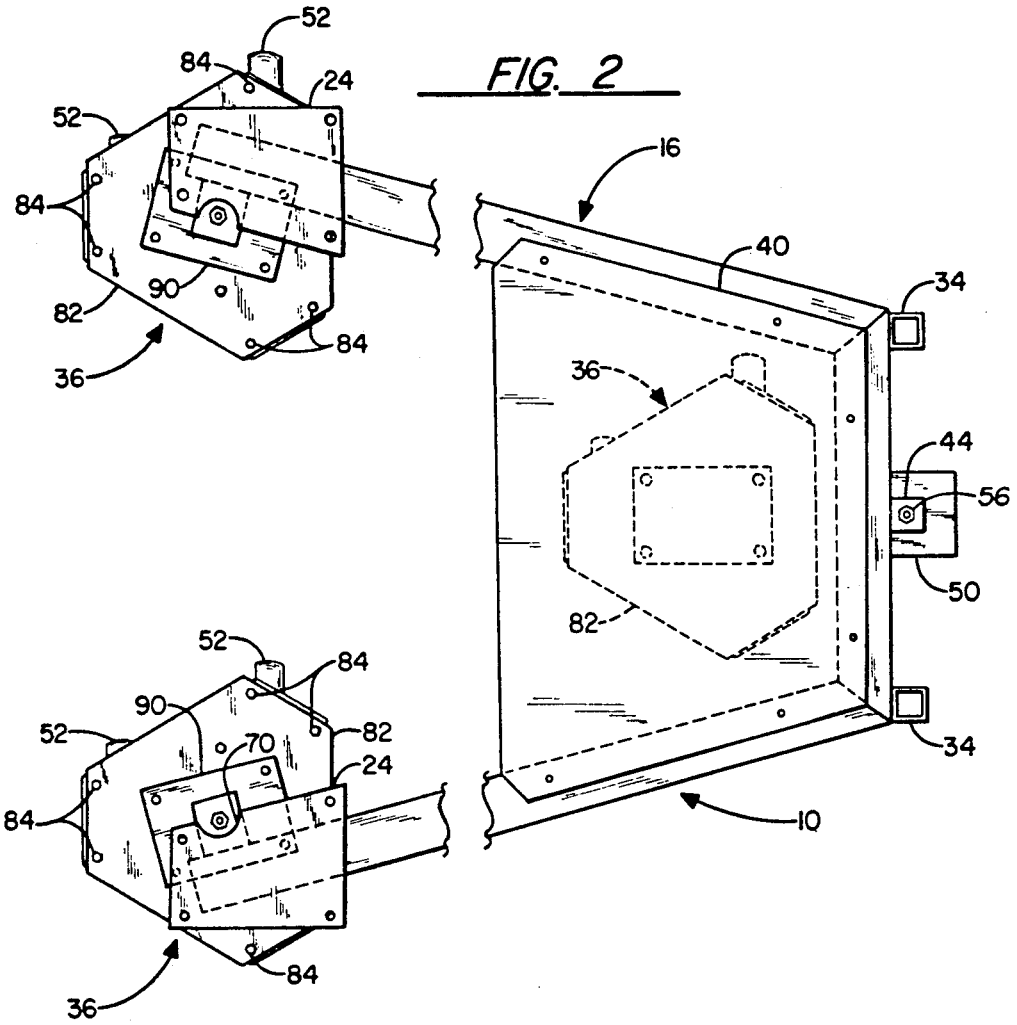
FIG. 2 is a top plan view of the base frame of the support of FIG. 1.
Figure 3:
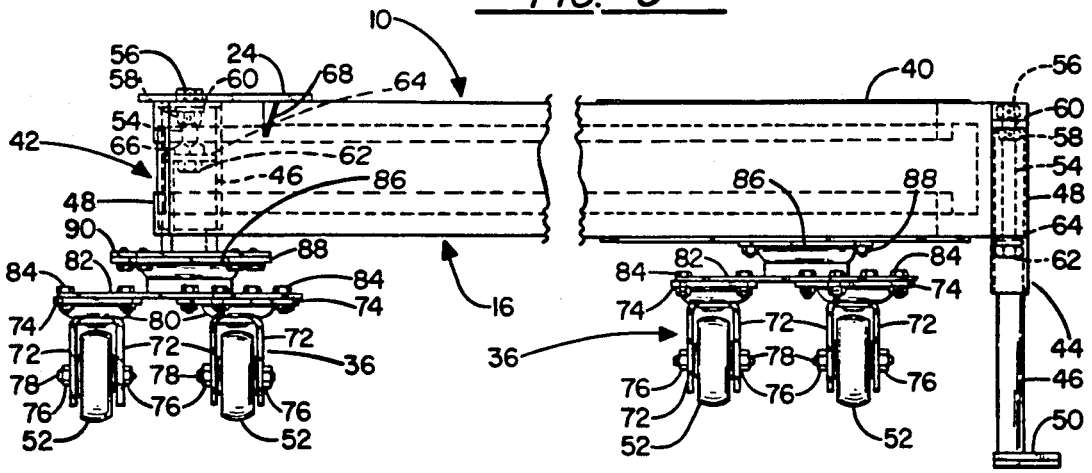
FIG. 3 is a side elevational view of the base frame of FIG. 2 with a rear outrigger in an extended position.

The figures, as previously discussed, illustrate a support structure 10 employing three caster assemblies 36. In order to afford a height adjustment and leveling feature, a telescoping element 42, 44, associated with each caster assembly 36, can be provided. FIGS. 1, 2, and 3 illustrate the location of the outrigger telescoping member 44 associated with the rear caster assembly. This outrigger 44 is, as shown in the figures, mounted in an appropriate manner (such as welding) to an outwardly facing surface of the C-shaped member substantially centrally along the portion of the C-shaped member defining the rear of the support structure 10.

The rear caster assembly outrigger includes inner and outer housings 46, 48 that telescope relative to one another. The outer housing 48 is secured to the C-shaped member, and the inner housing 46 is disposed for reciprocal movement downwardly relative thereto. It carries a pad 50 at a lower end thereof for engagement with the floor on which the support structure 10 is situated. The length of the inner housing 46 is such that, when it is at its lowermost position, it extends downwardly beyond lower extremities of the caster wheels 52 of the rear caster assembly 36. Consequently, the rear caster assembly 36 can be elevated relative to the floor.

The rear outrigger 44 effects elevation of the base frame 16, at the rear end thereof, by means of a threaded shaft 54 disposed at a fixed axial location relative to the outer housing 48. This can be accomplished by mounting stops 56, 58 to the shaft 54, proximate the upper end thereof, to sandwich a plate 60 closing the upper end of the outer housing 48. The stops 56, 58 can take the form of nuts which are pinned to the shaft 54.

A lower end of the shaft 54 can include a stop 62 (again, a nut either pinned or welded to the shaft 54) which engages an underside of a wall 64 of the inner housing 46 to preclude separation of the inner and outer housings 46, 48 from one another. The upper wall 64 of the inner housing 46 can have an internally threaded aperture 66 provided therein so that, as the shaft 54 is rotated, the inner housing 46 will move axially relative to the outer housing 48.

Each of the front caster assemblies 36, similarly, includes an inner/outer housing leveler assembly. In the case of the front caster assemblies, however, the inner/-outer housing height adjustment mechanism is interposed between the caster assembly 36 and the C-shaped member. Consequently, the base frame 16, at its front end, can be adjusted for height without the caster wheels 52 of those front caster assemblies 36 being elevated above the floor.

The height adjustment assemblies are similar in construction to that of the rear leveler outrigger 44. That is, they include inner and outer housings 46, 48 which are selectively adjustable along an axis relative to one another. A threaded shaft 54, fixed axially, yet rotatable, with respect to an upper wall 60 of the outer housing 48 is made to rotate within a threaded aperture 66 in an upper wall 64 of the inner housing 46. As rotation is accomplished, the inner housing 46 will be drawn into, or extended relative to, the outer housing 48, depending upon the direction of rotation of the shaft 54.

The forward caster assemblies 36 will now be described specifically with reference to FIGS. 4 and 5. A forwardly extending end of the C-shaped member is welded or secured to the underside of the plate 24 by which the tower frame 12 is mated to the base frame 16. An upper end of one of the front leveler assemblies is, in turn, welded to an innerface of the C-shaped member and to the underside of the mating plate 24, and a strengthening brace 68 can be provided.

Figure 4:
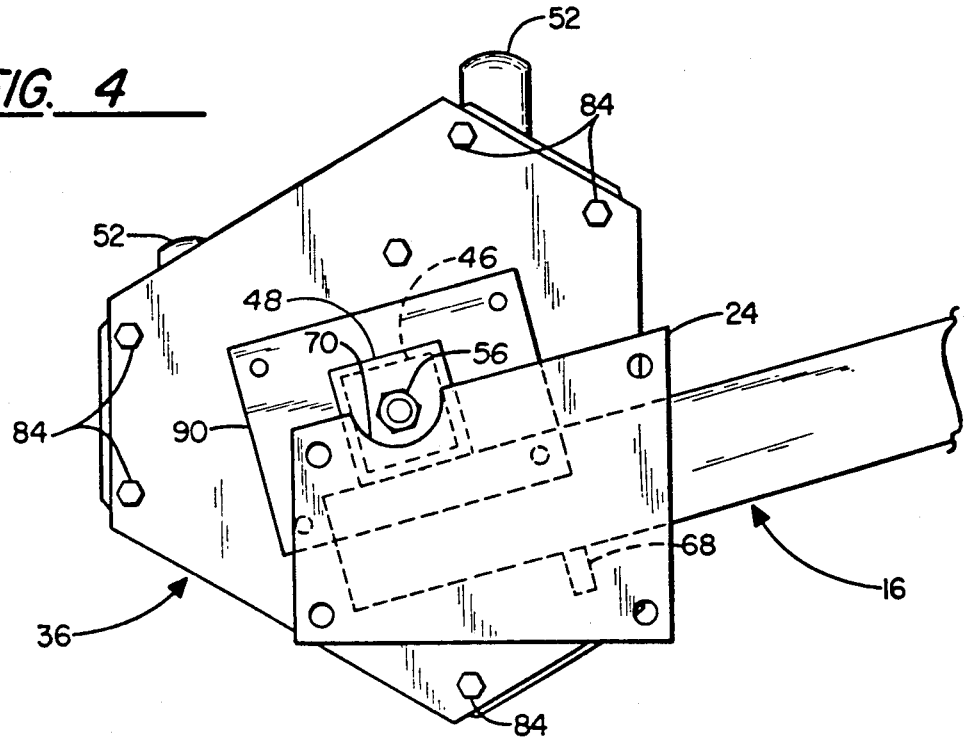
FIG. 4 is an enlarged plan view of a caster mounting member and caster assembly as seen in FIG. 2.
Figure 5:
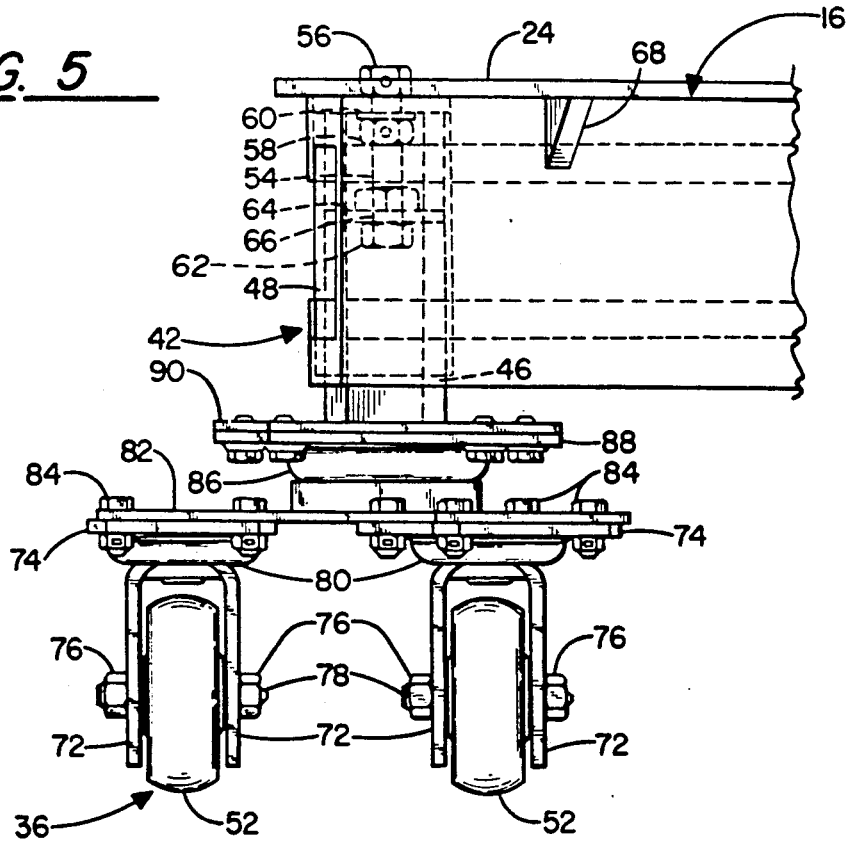
FIG. 5 is an enlarged elevational view of a caster mounting member and caster assembly as seen in FIG. 3.
Figure 6:
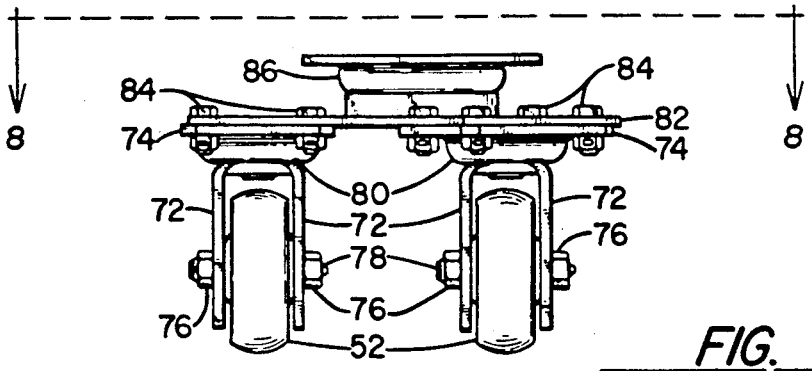
FIG. 6 is front elevational view of a caster assembly.
Figure 7:
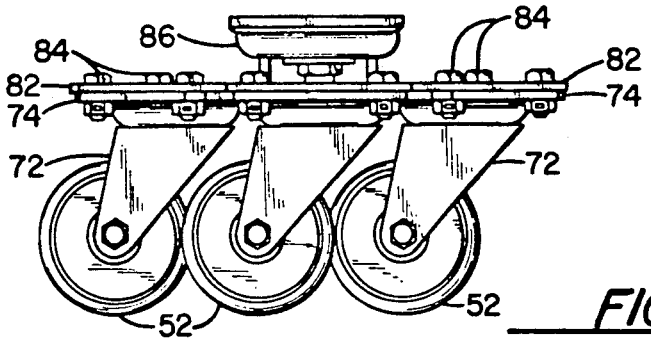
FIG. 7 is a side elevational view of a caster assembly.
Figure 8:
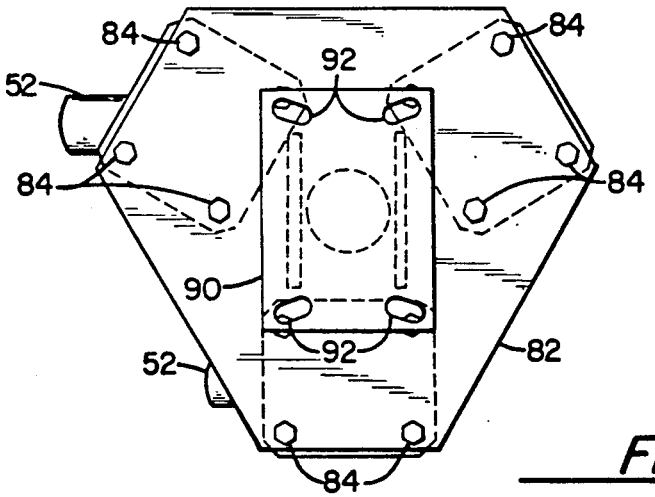
FIG. 8 is a plan view taken generally along line 8—8 of FIG. 5.

As seen in FIG. 4, an arcuate portion 70 of the mating plate 24 is cut out. By so doing, an appropriate relationship of the parts can be provided without access to a head of the threaded shaft 54 being obstructed.

The caster assembly comprises three caster wheels 52. Each wheel 52 is journalled between a pair of flanges 72 depending downwardly from an attachment plate 74. Journalling of the caster wheels 52 can be accomplished in any appropriate manner. The figures illustrate employment of nuts 75 which are secured onto threaded portions of axles 76 extending through the wheels 52. Appropriate bearings (not shown) can be employed to insure the ability of the caster wheels 52 to freewheel.

Each caster wheel 52 is associated with a swivel cup 80. Such a cup 80 houses bearings (not shown) or other appropriate means for permitting revolution of a corresponding caster wheel 52, through 360 degrees, about a generally vertically extending axis. The swivel 80 allows rotation relative to the attachment plate 74 with which it is associated.

The attachment plates 74 associated with the three caster wheels 52 of a particular caster assembly 36 are, in turn, secured to a caster mounting member 82 such as the truncated triangular plate illustrated in the figures. This securing is accomplished in any appropriate manner (for example, by a nut and bolt arrangement 84).

Each caster assembly 36, in turn, is associated with another swivel 86, the swivel 86 being disposed relative to an axis coinciding with a central axis of the caster mounting member 82. Again, a cup-like element is secured to a plate 88 with respect to which it rotates, and that plate 88 is, in turn, mated to another similarly sized and shaped plate 90 (rectangular as shown in the figures). Again, a nut/bolt arrangement can be employed for mating, and the upper plate 90 can be provided with elongated holes 92 to facilitate mating. The upper mating plate 90 is secured, for example, by welding to the bottom of the inner housing 46 of the height adjustment assembly.

As will be able to be seen in view of this disclosure, not only is each individual caster wheel 52 able to be revolved about a generally vertically extending axis, but the caster assembly 36 of which it is apart is also able to be rotated about a generally vertically extending axis. Consequently, maneuverability of the support structure 10 is maximized not only in a single direction, but in virtually any direction.

When utilizing the present invention, as described herein, to form a backdrop, for example, the tower frame 12 is secured to the support structure 10 by appropriate means as previously described. A face panel is, in turn, secured to the tower frame 12. Either prior to, concurrently with, or immediately after, affixation of a face panel, the appropriate counter-weight of counter-weights are placed in the counter-weight box 40. With the assembly thus configured, it is ready to be maneuvered so that the face panel carried thereby can be mated in an abutting relationship to another panel.

Mating is accomplished by maneuvering support strucures 10 into positions wherein panels carried thereby are generally at locations relative to other panels as intended. Lower edges of the various panels are aligned by manipulation of the various leveler assemblies at the fronts of the support structures 10. The lower edges are aligned at a desired height such that concealing of what is behind the panels is maximized.

With the lower edges of the panels aligned and leveled, the panels can be made coplanar by adjusting the rear outrigger 44. As an outrigger 44 is adjusted, its pad 50 engages the floor to function as a brake and preclude significant movement of the support structure 10 and the panel mounted thereon.

As the rear end of a support structure 10 is raised to tilt the panel forwardly, the lower edge of the panel being tilted may rise slightly. It would, therefore, become necessary to again adjust the forward height-adjustment/leveler assemblies. These adjustments would, of course, be "fine tuning" of positions.

Additionally, it might be necessary to adjust the lateral positioning of one panel relative to another. This can, of course, be easily accomplished because of the caster and caster mounting member arrangement as defined herein.

Numerous characteristics and advantages of the invention of this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A support structure for mounting stage backdrop panels and the like, comprising:

(a) a base frame;

(b) at least one caster mounting member rotatably carried by said base frame, for rotation about a generally vertical mounting member axis;

(c) a plurality of casters carried by said at least one mounting member, each of said casters being rotatably carried by said at least one mounting member about a generally vertical individual caster axis, each of said individual caster axes being offset from said mounting member axis, whereby each caster is rotatable about its respective individual caster axis, and each individual caster axis is rotatable about said mounting member axis; and (d) telescoping adjustment means for selectively raising and lowering said base frame, said adjustment means interposed between said base frame and said at least one caster mounting member and coaxial with said mounting member axis.

2. The invention as claimed in claim 1, including means for selectively raising and lowering said base frame relative to said caster mounting member whereby the height of said base frame can be adjusted while said base frame is rollably supported by said casters.

3. The invention as claimed in claim 1, said base frame being provided with three points of support, two of said three points defining a front of said base frame, said support structure including a plurality of caster mounting member with respective casters, and each of said three points of support having one of said caster mounting members operably coupled thereto.

4. The invention as claimed in claim 3, including means, interposed between said base frame and the caster mounting members at said two of said three points of support defining said front of said base frame, for selectively raising and lowering said base frame relative to said caster mounting members.

5. The invention as claimed in claim 4, including means for selectively raising said remaining caster mounting member at said third point of support relative to said floor whereby the casters of said remaining caster mounting member can be lifted out of ground engaging contact with said floor.

6. The support structure according to claim 1, wherein said telescoping adjustment means comprises inner and outer shiftable telescoping elements, said inner element shiftable into and out of said outer element.

7. The support structure according to claim 6, wherein said elements are angular.

8. A support structure for mounting stage backdrop panels and the like, comprising:

a base frame;

a support member including stage engaging wheels;

carrying means interposed between said base frame and said support member for rotatably carrying said support member relative to said base frame;

said carrying means including means for telescopically adjusting the height of said base frame relative to said support member including rotatable actuation means and means for isolating the rotational movement of said actuation means from said means for telescopically adjusting the height of said base frame relative to said support member.

9. The support structure according to claim 8, wherein the leveling means is operated from above said base frame and comprises generally coaxial and angular inner and outer housings and a threaded shaft received coaxially within said housings and threadably coupled to said inner housing, whereby said housings are selectively adjustable relative to each other along said threaded shaft.

10. The support structure according to claim 8, wherein said means for telescopically adjusting the height of said base frame relative to said support member is angular.

11. The support structure according to claim 10, wherein said adjustment means is operable from above said base frame.

12. A support structure for supporting stage backdrop panels comprising:

a base frame;

a plurality of caster mounting members rotatably operably coupled to the base frame, and having an axis of rotation at a fixed angle relative to the mounting members and the base frame; and a plurality of casters for contacting the stage, the casters operably rotatably coupled to the mounting members, whereby when the points of contact between the stage and the casters are not coplanar, the axes of rotation of the mounting members tend to remain at said fixed angle.

13. The support structure according to claim 12, wherein the axes of rotation of the mounting members are generally vertical.

14. The support structure according to claim 13, further comprising leveling means adjacent said caster mounting members for leveling said base frame.

15. The support structure according to claim 14, wherein the leveling means is operated from above said base frame and comprises generally coaxial and angular inner and outer housings and a threaded shaft received coaxially within said housings and threadably coupled to said inner housing, whereby said housings are selectively adjustable relative to each other along said threaded shaft.

16. The support structure according to claim 15, further comprising weight means for compensating for the weight of the panel supported by the support structure.

* * * * *